US005782507A

United States Patent [19]

Hardee

[11] Patent Number: 5,782,507

[45] Date of Patent: Jul. 21, 1998

[54] GATE LATCH WITH LATCHING MEANS

[76] Inventor: Carl B. Hardee, 2271 Hwy. 348, Loris, S.C. 29569

[21] Appl. No.: 837,995

[22] Filed: Apr. 15, 1997

[51] Int. Cl.[6] ..... E05C 5/00

[52] U.S. Cl. ..... 292/67; 292/236; 292/145

[58] Field of Search ..... 292/188, 189, 292/236, 238, 67, 71, 162, 145, 218, 202

[56] References Cited

U.S. PATENT DOCUMENTS

| | | | |
|---|---|---|---|
| 668,208 | 2/1901 | Pickett | 292/67 |
| 873,185 | 12/1907 | Strattor | 292/202 |
| 891,667 | 6/1908 | Browning | 292/238 |
| 1,326,554 | 12/1919 | Watson | 292/67 |
| 2,794,663 | 6/1957 | Grodt et al. | 292/67 |
| 4,014,192 | 3/1977 | Dillon et al. | 292/236 |
| 4,062,575 | 12/1977 | Robins | 292/67 |
| 4,643,469 | 2/1987 | Johnston et al. | 292/67 |
| 5,511,835 | 4/1996 | Hardee | 292/67 |

FOREIGN PATENT DOCUMENTS

| | | | |
|---|---|---|---|
| 231626 | 4/1925 | United Kingdom | 292/236 |
| 412000 | 6/1934 | United Kingdom | 292/67 |
| 792777 | 11/1955 | United Kingdom | 292/67 |

*Primary Examiner*—Darnell M. Boucher
*Attorney, Agent, or Firm*—W. Alex Dallis, Jr.

[57] ABSTRACT

A gate and door latch having alternate means of opening and closing either by a horizontal sliding action of a striker or pivoting of the striker. The striker is manipulated into an open or closed position by means of latching or unlatching the striker member from a pronged keeper. A striker slot allows the striker member to be slid horizontally from side to side in an open or closed position or to pivot about a striker pivot bolt in an open or closed position. A rear lever handle is secured to the back side of the gate or door allowing for opening or closing the latch from the rear by rotating the rear lever handle. Rotation of the rear lever handle actuates a lever located on the front side of the gate and door latch causing the lifting and pivoting of the striker into an open position.

7 Claims, 4 Drawing Sheets

GATE LATCH WITH LATCHING MEANS

BACKGROUND OF THE INVENTION

1. Field of the Invention

The present invention relates to the field of gate and door latches and, more particularly, to a gate and door latch having an alternate means for latching and unlatching.

2. Description of the Related Art

The field of door and gate latches is an area of invention that has existed as long as the need to secure gates and doors has existed. Although the primary purpose served by a latch can be met by perhaps the most basic and simple design, the nuances of a more complex but effective latch design may be easily overlooked. The typical latch design requires a latching means provided in a closed door or gate position and simple unlatching means for the opening of a door or gate. The typical means by which the door or gate is opened is accomplished by some handle means which is turned, pushed, pulled or otherwise manipulated to effect the unlatching of the latch device.

The present invention differs from the existing art in that it incorporates alternate means of latching and unlatching a striker member to a pronged keeper. The striker member is equipped with an L-shaped striker slot which allows for easy pivoting or sliding of the striker necessary to achieve an open or closed position.

SUMMARY OF THE INVENTION

It is therefore an objective of this invention to provide a gate and door latch having both front pivoting means for opening as well as a sliding means for opening.

It is further an objective of this invention to provide gate and door latch having a lever means for pivoting the striker in an open position from a rear lever handle attached to the back side of the door or gate.

It is still further an objective of this invention to provide facile means for locking the striker member to a stirrup keeping the striker member in a closed position.

These as well as other objectives are accomplished by a gate and door latch having a striker with a striker handle used to manipulate the striker into an open or closed position by means of latching or unlatching the striker member from a pronged keeper. The striker member is designed with a striker slot that allows the striker member to be slid horizontally from side to side in an open or closed position or to pivot about a striker pivot bolt in an open or closed position. A rear lever handle is secured to the back side of the gate or door allowing for opening or closing the latch from the rear by rotating the rear lever handle. Rotating the rear lever handle actuates a lever located on the front side of the gate and door latch causing the lifting and pivoting of the striker into an open position.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
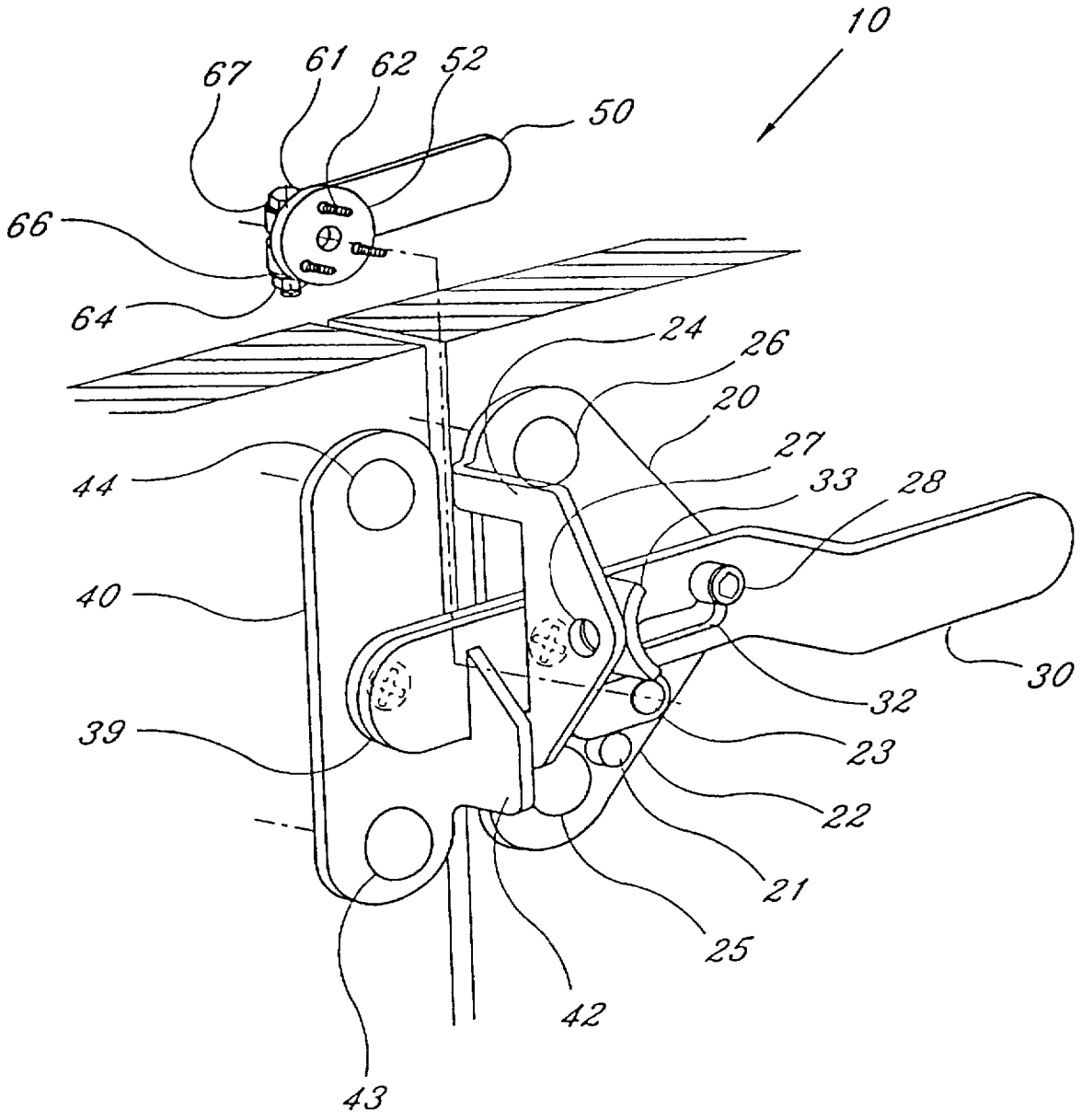
FIG. 1 of the drawings is a perspective view of the gate and door latch showing the latch in the closed position with a break-away view of the rear handle.

Referring to the drawings by numerals of reference, there is shown in FIGS. 1, 2, 3 and 4 the gate and door latch (10). The basic components of the gate and door latch (10) include a striker member (39) pivotally secured to a striker mount (20). The striker member (39) latches to a keeper mount (40) by means of the pronged keeper (42). The gate and door latch (10) may be opened or closed from the opposite side of the door or gate by means of a rear lever handle (50).

Referring to FIG. 1, the gate and door latch (10) is shown in the closed position. The front mounting means of the gate and door latch (10) include a striker mount (20) and opposing keeper mount (40). Opposite the striker mount (20) on the opposite side of the door or gate is the lever mount (52) used as a mount for the rear lever handle (50). The striker mount (20) is secured to the door or gate by means of a bottom striker mount bolt (25) and a top striker mount bolt (26). Extending perpendicularly from the striker mount (20) opposite the door or gate, is the stirrup (24) through which operates the striker member (39) for latching and unlatching. Opposite the stirrup (24) is the keeper mount (40) which is bolted to a fixed wall or post by means of a bottom keeper bolt (43) and a top keeper bolt (44). In the closed position, the striker member (39) rests inside the pronged keeper (42) which is an extension of the keeper mount (40).

Figure 2:
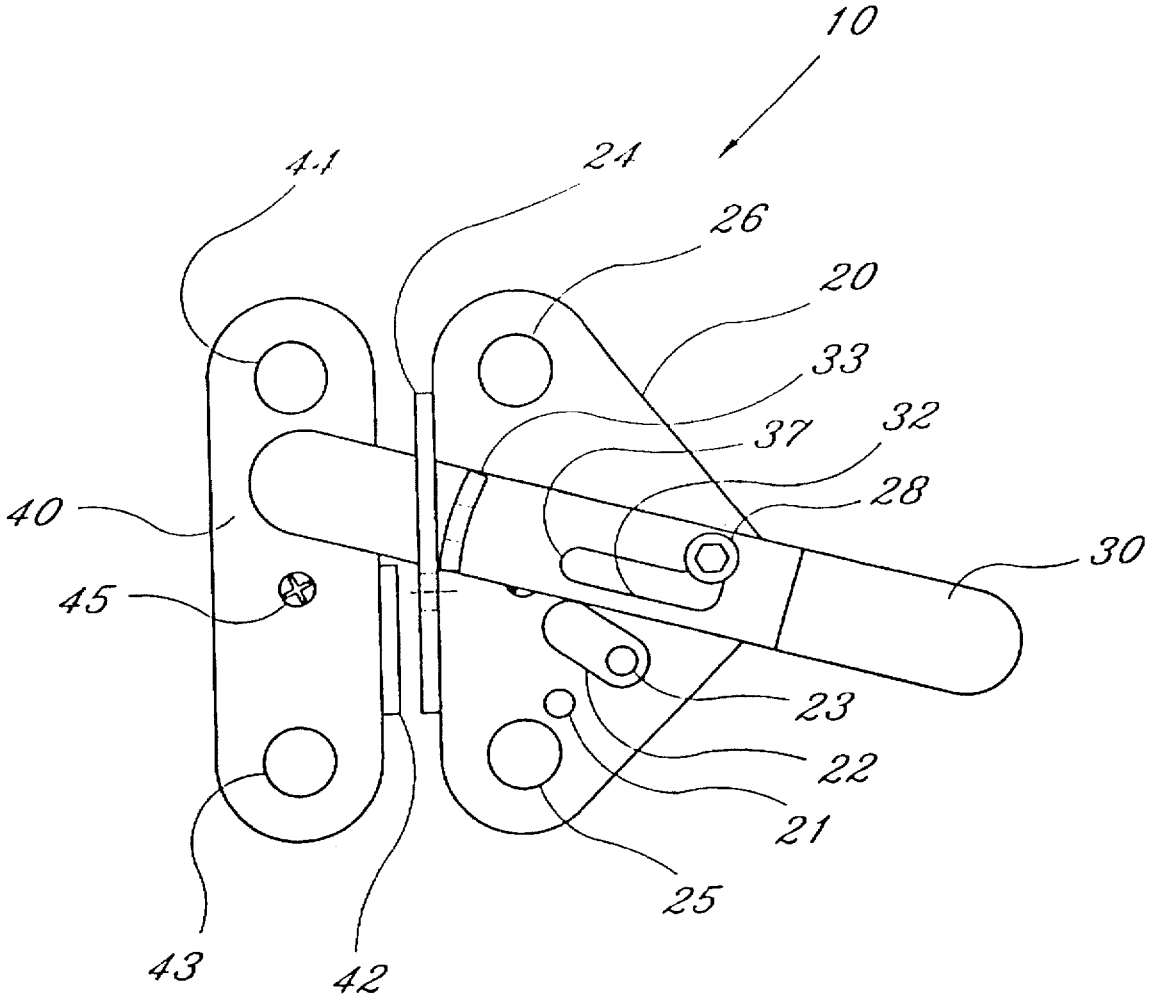
FIG. 2 of the drawings is a front plan view of the gate and door latch showing the latch in the pivot-open position.

Continuing with reference to FIG. 1, one can observe the relationship between the rear lever handle (50) and the striker member (39) on the opposite side of the door or gate. One means of opening the gate and door latch involves pivoting the striker member (39) about the striker pivot bolt (28) by pulling or pushing down on the striker handle (30). This pivoting action may also be accomplished by the turning operation of the rear lever handle (50). When the rear lever handle (50) is rotated in the downward position, the rotational moment is translated through the lever pivot rod (23) causing the upward pivot action of the lever cam end (22). Since the lever cam end (22) directly abuts the striker member (39), an upward pivot action of the lever cam end (22) causes the striker member (39) to pivot about the striker pivot bolt (28) thereby releasing the striker member (39) from the pronged keeper (42). The striker flange (33) has a flange aperture (34), as shown in FIG. 2, that aligns with the stirrup aperture (27) in the closed position so that the striker member (39) may be locked in the closed position against the pronged keeper (42). The striker flange (33) has a curvature so that the striker flange (33) does not interfere with the pronged keeper (42) when the striker member (39) is pivoted about the striker pivot bolt (25). When in the closed position, the lever cam end (22) rest against the lever rest (21).

Still referring to FIG. 1, the gate and door latch (10) is secured to a gate or door by means of top striker mount bolt (26) and a bottom striker mount bolt (25). Opposite the striker mount (20), the keeper mount (40) is secured to the stationary wall or post by means of a top keeper bolt (44) and a bottom keeper bolt (43). The rear lever handle (50) has a lever mount (52) that secures to the gate or door on the opposite side of the striker mount (20). The lever mount (52) is fastened to the door or gate by means of lever mount screws (62). The rear lever handle (50) is tightened onto the lever pivot rod (23) through the lever mount aperture (77) by means of a clamp bolt (61) and clamp bolt nut (64).

Referring to FIG. 2, a front plan view of the gate and door latch (10) illustrates more precisely the operation of the lever cam end (22) and how it releases the striker member

(39) from the pronged keeper (42) when the rear lever handle (50), as shown in FIG. 1, is rotated downward. Manipulation of the rear lever handle (50) induces the upward rotation of the lever cam end (22) off the lever rest (21) and around the pivot point of the lever pivot rod (23). This action of the lever cam end (22) causes the striker member (39) to pivot upward about the striker pivot bolt (28). The striker handle (30) correspondingly falls into a downward position as though being pulled down by an human hand. The striker member (39) will unlatch from the pronged keeper (42) in the same way when [without the aid of the lever cam end (22)] direct downward pressure is applied to the striker handle (30).

Figure 3:
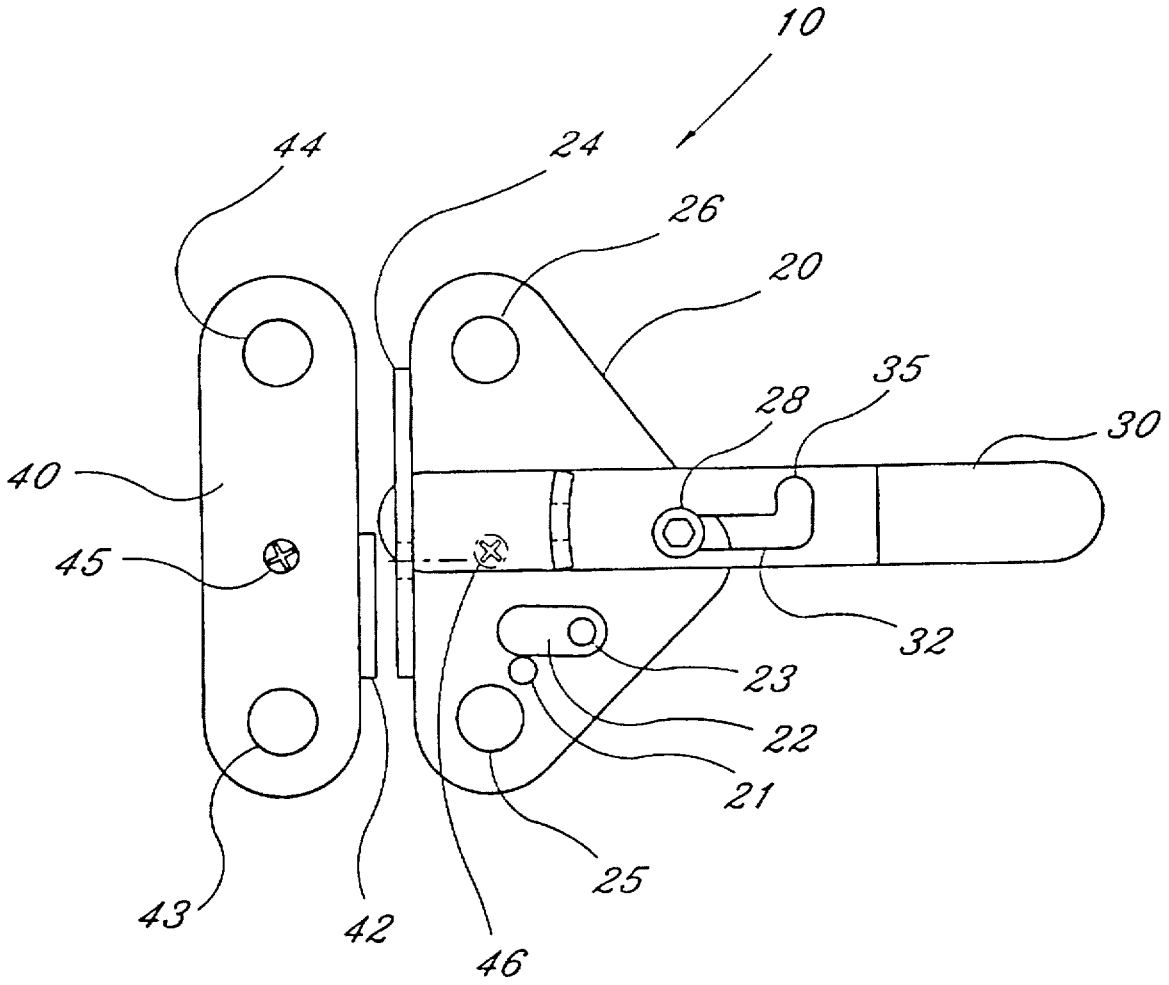
FIG. 3 of the drawings is a front plan view of the gate and door latch showing the latch in the slide-open position.

Referring to FIG. 3, a different front plan view of the gate and door latch (10) reveals the alternative opening means provided by the gate and door latch (10). Instead of using a pivoting action to release the striker (20) from the pronged keeper (42), the striker (20) is lifted slightly in the vertical direction so that the striker pivot bolt (28) resides in the bottom portion of the striker slot (32). The striker member (39) is then slid horizontally to the right until the striker pivot bolt (28) abuts the horizontal slot end (37) as depicted in FIG. 2. Both a keeper mount screw (45) and a striker mount screw (46) are used to provide added security in addition to the top and bottom keeper mount bolts (44 and 43) and top and bottom striker mount bolts (25 and 26).

Figure 4:
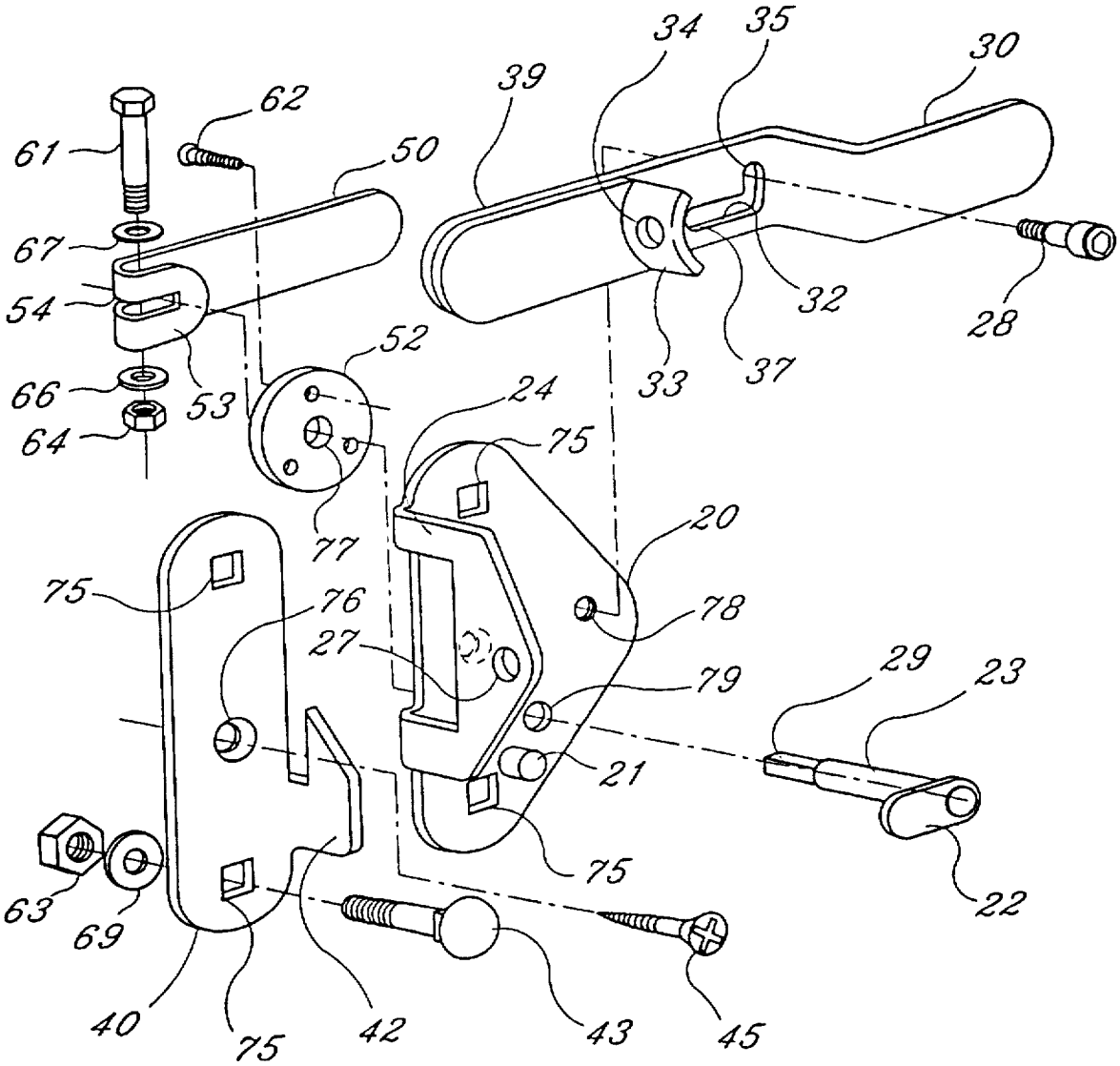
FIG. 4 of the drawings is a perspective view of the gate and door latch showing exploded views of the various components of the gate and door latch and their interaction.

Referring to FIG. 4, a perspective blow-up view of all the essential components of the gate and door latch (10) is shown. Beginning with the striker mount (20), there is a stirrup (24) protruding perpendicularly from the striker mount (20) so as to provided an operating face and locking means for the striker member (39) and striker flange (33). The striker mount (20) is secured to a door or gate by bolts that pass through the square bolt apertures (75). The striker member (39) is pivotally secured to the striker mount (20) by means of a half threaded striker pivot bolt (28). The striker member (39) is designed with an L-shaped striker slot (32) having a vertical slot end (35) and a horizontal slot end (37). With proper manipulation of the striker handle (30) the striker member (39) is pivoted about the striker pivot bolt (28) when striker pivot bolt (28) is resting against the vertical slot end (35). The striker handle (30) can also be used to slide the striker member (39) horizontally in the open position.

Continuing with reference to FIG. 4, the details of the lever cam end (22), lever pivot rod (23) and squared pivot rod end (29) can be seen. The entire lever pivot rod (23) is rotatable secured into the lever rod aperture (79) through the lever mount aperture (77) so that the squared pivot rod end (29) is fixed to the rear lever handle (50) by means of the rear lever slot clamp (54). This rear lever slot clamp (54) is clamped onto the squared pivot rod end (29) by tightening the clamp bolt (61) with a top clamp bolt washer (67), a bottom clamp bolt washer (66) and a clamp bolt nut (64). The axis formed by the lever pivot rod (23) is preserved by fixing the lever mount (52) to the back side of the door or gate by means of lever mount screws (62). The keeper mount (40) is secured opposite the stirrup (24) and striker mount (20) by means of an mounting bolts that secure through the square bolt apertures (75).

A preferred embodiment of the present invention is described herein. It is to be understood, of course, that changes and modifications may be made in the embodiment without departing from the true scope and spirit of the present invention as defined by the appended claims.

That which is claimed is:

1. A gate and door latch having alternative latching means, comprising in combination:

A striker member having a latching end and a striker handle, said striker handle extending from said striker member in an off-set fashion from a plane occupied by said striker member such that said striker handle may be easily grasped by a human hand;

a striker slot cut into said striker member, said striker slot being centrally located on said striker member having a uniform slot width, said striker slot further comprising a vertical slot end and a horizontal slot end, said vertical slot end joining said horizontal slot end at an approximate right angle;

a striker mount having a plurality of square bolt apertures for insertion of striker mount bolts to secure said striker mount to said door, said striker mount having a stirrup extending in a perpendicular fashion from said striker mount opposite said door, said stirrup having an opening through which said latching end of said striker member pivots and slides between an open and closed position, said opening of said stirrup confining a pivoting action of said latch end of said striker member;

a striker pivot bolt having a threaded end, a pivot neck and a pivot bolt head, said striker pivot bolt being inserted through said striker slot for securing said threaded end of said striker pivot bolt into a pivot bolt aperture of said striker mount so that said striker member may pivot on said pivot neck, said pivot bolt head having a diameter greater than said width of said striker slot and said pivot neck having a diameter slightly less than said width of said striker slot;

a means for locking said striker member to said stirrup of said striker mount; and a keeper mount having a pronged keeper and plurality of square bolt apertures through which keeper bolts secure said keeper mount to a surface adjacent and opposite said striker mount, said keeper mount being aligned with said striker mount so that said pronged keeper receives said latching end of said striker member maintaining said door in a closed position.

2. The gate and door latch according to claim 1 wherein said latching end of said striker member is placed in a latched position with said pronged keeper by sliding said striker member laterally toward said keeper mount causing said striker member to ride slide on said pivot bolt along said horizontal slot end of said striker slot until said latching end of said striker member is secured between said keeper mount and said pronged keeper and said striker member drops slightly in a vertical direction when said striker pivot bolt slide up said vertical slot end of said striker slot, said striker member being removable from said latched position by lifting said striker member slightly in the vertical direction and sliding said striker member laterally away from said keeper mount causing said striker member to slide on said pivot bolt along said horizontal slot end of said striker slot until said latching end is released from between said keeper mount and said pronged keeper.

3. The gate and door latch according to claim 1 wherein said latching end of said striker member is removed from a latched position between said pronged keeper and said striker mount by a downward force applied to said striker handle causing said striker member to pivot on said striker pivot bolt releasing said latching end of said striker member from between said pronged keeper and said keeper mount.

4. The gate and door latch according to claim 1 further comprising:

a lever pivot rod having a lever cam end and a squared pivot rod end, said lever pivot rod passing through a lever rod aperture of said striker mount below said striker member, said lever cam end of said lever pivot rod being of a cam configuration providing eccentric rotation along an axis passing through a length of said lever pivot rod;

a lever mount secured on the opposite side of said door directly opposite said striker mount, said lever mount having a lever mount aperture through which said lever pivot rod passes; and a rear lever handle secured to said squared pivot rod end of said lever pivot rod by means of a rear lever slot clamp that grips said squared pivot rod end with aid of a clamp bolt such that said rear lever becomes rotationally fixed to said lever pivot rod.

5. The gate and door latch according to claim 4 wherein said latching end of said striker member is removed from a latched position between said pronged keeper and said striker mount by a downward force applied to said rear lever handle causing rotation of said lever pivot rod and said lever cam end, said lever cam end pushing up onto said striker member causing said striker member to pivot on said striker pivot bolt releasing said latching end of said striker member from between said pronged keeper and said keeper mount.

6. The gate and door latch according to claim 5 wherein said striker mount further comprises a lever rest, said lever rest acting as a stop for said lever cam end of said lever pivot rod when said lever pivot rod is in a resting position.

7. The gate and door latch according to claim 1 wherein said means for locking said striker member to said stirrup of said striker mount comprises a striker flange having a flange aperture through which a padlock passes through both said flange aperture and a stirrup aperture thereby locking said latching end of said striker member between said keeper mount and said pronged keeper.

* * * * *